US008584808B2

(12) United States Patent
Malrait et al.

(10) Patent No.: US 8,584,808 B2
(45) Date of Patent: Nov. 19, 2013

(54) METHOD AND DEVICE FOR CONTROLLING A LIFTING LOAD

(75) Inventors: Francois Malrait, Jouy sur Eure (FR); Stefan Capitaneanu, Mousseaux Neuville (FR)

(73) Assignee: Schneider Toshiba Inverter Europe SAS, Pacy sur Eure (FR)

( * ) Notice: Subject to any disclaimer, the term of this patent is extended or adjusted under 35 U.S.C. 154(b) by 455 days.

(21) Appl. No.: 13/063,077

(22) PCT Filed: Oct. 13, 2009

(86) PCT No.: PCT/EP2009/063334

§ 371 (c)(1),
(2), (4) Date: Mar. 9, 2011

(87) PCT Pub. No.: WO2010/046275

PCT Pub. Date: Apr. 29, 2010

(65) Prior Publication Data

US 2011/0166697 A1 Jul. 7, 2011

(30) Foreign Application Priority Data

Oct. 22, 2008 (FR) ..... 08 57167

(51) Int. Cl.
*B66B 1/28* (2006.01)

(52) U.S. Cl.
USPC ..... 187/295; 187/391

(58) Field of Classification Search
USPC ..... 187/247, 293, 295–297, 391–393; 318/66, 68, 162–164, 268–271
See application file for complete search history.

(56) References Cited

U.S. PATENT DOCUMENTS

| | | | | |
|---|---|---|---|---|
| 4,751,984 | A * | 6/1988 | Williams et al. | 187/293 |
| 5,035,301 | A * | 7/1991 | Skalski | 187/295 |
| 5,325,036 | A * | 6/1994 | Diethert et al. | 318/802 |
| 6,311,802 | B1 * | 11/2001 | Choi et al. | 187/293 |
| 7,533,763 | B2 * | 5/2009 | Kattainen et al. | 187/394 |
| 8,459,415 | B2 * | 6/2013 | Kwon et al. | 187/295 |
| 2007/0227828 | A1 * | 10/2007 | Kinpara et al. | 187/295 |
| 2010/0126809 | A1 * | 5/2010 | Foschini et al. | 187/293 |
| 2012/0111670 | A1 * | 5/2012 | Fargo et al. | 187/247 |

FOREIGN PATENT DOCUMENTS

| | | |
|---|---|---|
| DE | 11 00 898 | 3/1961 |
| DE | 102 96 269 | 3/2004 |
| GB | 1 560 348 | 2/1980 |

OTHER PUBLICATIONS

International Search Report issued Dec. 1, 2009 in PCT/EP09/063334 filed Oct. 13, 2009.

* cited by examiner

*Primary Examiner* — Anthony Salata
(74) *Attorney, Agent, or Firm* — Oblon, Spivak, McClelland, Maier & Neustadt, L.L.P.

(57) ABSTRACT

A control method implemented in a variable speed drive for controlling a lifting load, the load control being carried out according to a first control profile that includes the following: accelerating the load with a view to reaching a first speed, decelerating the load upon receiving a deceleration order, and stopping the load. When the load receives a deceleration order when it is at a current speed lower than the first speed, the method determines a second speed lower than the first speed and higher than the current speed, the second speed having an optimal value for minimizing the load running time until stopping.

14 Claims, 2 Drawing Sheets

Figures 1A, 1B:
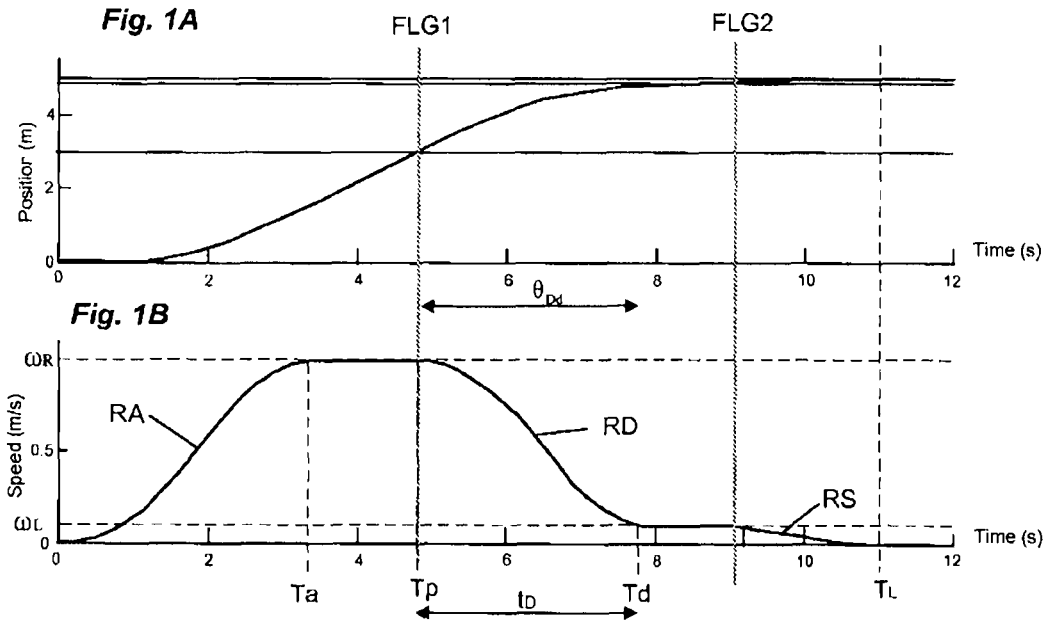

FLG1
FLG2
Position (m)
Time (s)
θDd

ωR
RA
RD
RS
Speed (m/s)
ωL
Time (s)
Ta
Tp
tD
Td
TL

METHOD AND DEVICE FOR CONTROLLING A LIFTING LOAD

The present invention pertains to a method of control implemented in a variable speed drive for controlling a lifting load such as an elevator. The invention also relates to a variable speed drive suitable for implementing said method.

As a general rule, the control profile for a lifting load such as an elevator which moves between floors comprises the following main steps:

- an acceleration up to a first speed,
- the receipt of a deceleration order when the elevator has reached a certain level, this order possibly being given as the elevator passes in front of an external sensor,
- a first deceleration down to a second speed below the first speed,
- the receipt of a stopping order when the elevator is close to the arrival floor, this order also possibly being given as the elevator passes in front of a second sensor,
- a second deceleration until stopping.

Depending on the duration required to reach the first speed subsequent to the acceleration and the duration required to reach the second speed subsequent to the first deceleration, the profile may also comprise a step of maintaining the speed of the elevator at the first speed before the first deceleration and a step of maintaining at the second speed before the second deceleration.

The first speed is set so as to be the maximum speed to be reached by the elevator during a run between two floors separated by several levels. Now, when the elevator has to perform a shorter run, for example between two floors separated by a single level, this maximum speed is often never reached. In such a situation the elevator is nevertheless controlled according to the control profile defined hereinabove. The elevator therefore receives the deceleration order before having reached its maximum speed and therefore starts the first deceleration earlier according to one and the same speed profile as if the maximum speed had been reached. Now, at the moment of receipt of the deceleration order, the elevator has traveled only a small distance. Throughout the remaining distance before receipt of the stopping order, the elevator therefore moves at low speed. The duration spent by the elevator at the low speed is therefore very long.

Patent GB1560348 describes a solution making it possible to alleviate this problem. This document describes the application of a first speed profile to an elevator, this profile comprising an acceleration until a maximum speed is reached, followed by a first deceleration down to a low-speed plateau before a new deceleration until stopping. When the braking order which controls the first deceleration occurs while the maximum speed has not been reached, this document proposes the introduction of a second speed profile making it possible to shift the start of the first deceleration. The new instant of braking occurs at the intersection between the two speed profiles. In this prior art document, the aim is thus to recover the distance lost because of the overly premature intervention of the deceleration order by continuing the acceleration up to a new speed in accordance with the initial acceleration ramp. However, by preserving the initial acceleration ramp to reach the new speed, the remaining distance to be traveled will be complied with but not the duration.

Document EP0826621 describes for its part a scheme for adjusting the low speed of an elevator cabin by applying a compensation frequency in the control.

The aim of the invention is to propose a method of control making it possible to minimize the time spent at low speed when the elevator performs a run such that it receives the deceleration order before having reached its maximum speed.

This aim is achieved by a method of control implemented in a variable speed drive for controlling a lifting load, the control of the load being carried out according to a first control profile which comprises the following main steps:

- acceleration of the load with a view to reaching a first speed,
- deceleration of the load subsequent to the receipt of a deceleration order,
- stopping of the load, characterized in that when the load receives the deceleration order while it is at a current speed below the first speed, the method comprises:

- a step of determining a second speed below the first speed and above the current speed, said second speed having an optimal value so as to minimize the travel time of the load until stopping,
- a step of generating and applying a second control profile replacing the first control profile and comprising a step of accelerating the load until reaching the second speed according to a non-linear acceleration ramp taking account of the remaining distance to be traveled, followed by a deceleration step and by a stopping step.

According to one feature of the invention, the second control profile can comprise a step of maintaining the speed of the load at the second speed for a determined duration.

According to another feature, between the deceleration step and the stopping step, the second control profile comprises a step of maintaining the speed of the load at a third speed below the second speed.

According to another feature, on completion of the deceleration step, the second control profile comprises a step of receiving a stopping order.

According to another feature, after receipt of the stopping order, the second control profile comprises a step of deceleration until stopping.

According to another feature, the deceleration order or the stopping order is dispatched by an external sensor able to detect the passage of the lifting load or may be dispatched by an automaton connected to the variable speed drive.

The invention also relates to a variable speed drive making it possible to control the lifting load, the control of the load being carried out according to a first control profile which comprises the following steps:

- acceleration of the load with a view to reaching a first speed,
- receipt of a deceleration order,
- deceleration of the load,
- stopping of the load, characterized in that, when the load receives the deceleration order at a current speed below the first speed, the variable speed drive implements:

- means for determining a second speed below the first speed and above the current speed, said second speed having an optimal value so as to minimize the travel time of the load until stopping,
- means for generating and implementing a second control profile replacing the first control profile and comprising a step of accelerating the load until reaching the second speed according to a non-linear acceleration ramp taking account of the remaining distance to be traveled, followed by a deceleration step and by a stopping step.

According to one feature of the invention, the variable drive comprises means for maintaining the speed of the load at the second speed for a determined duration.

According to another feature, the variable speed drive comprises means for maintaining the speed of the load at a third speed below the second speed.

According to another feature, the second control profile comprises a receipt of a stopping order.

According to another feature, the second control profile comprises a deceleration until stopping subsequent to the receipt of the stopping order.

According to another feature, the variable drive is connected to an external sensor able to dispatch the deceleration order or the stopping order when it detects the passage of the lifting load. As a variant, the variable drive may be connected to a programmable automaton able to dispatch the deceleration order or the stopping order.

Figure 2A:
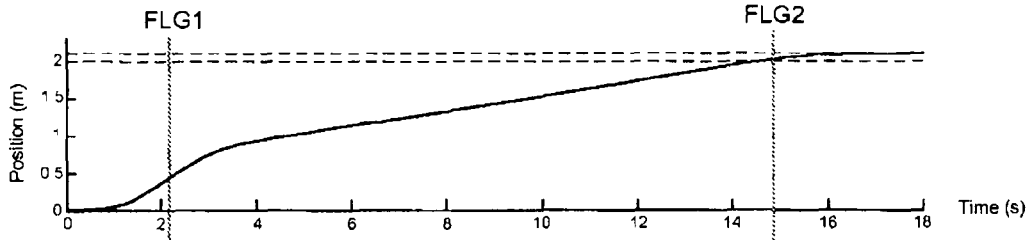
Figure 2B:
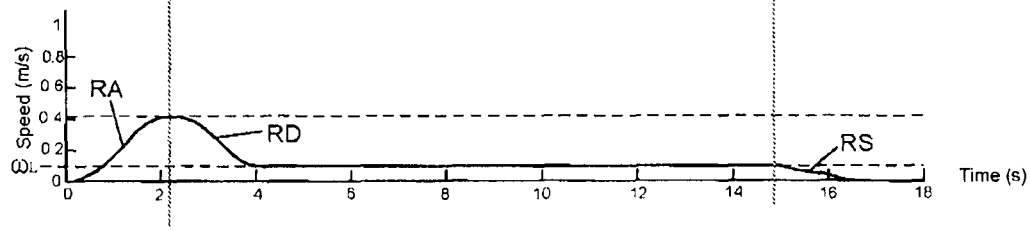
Figure 3A:
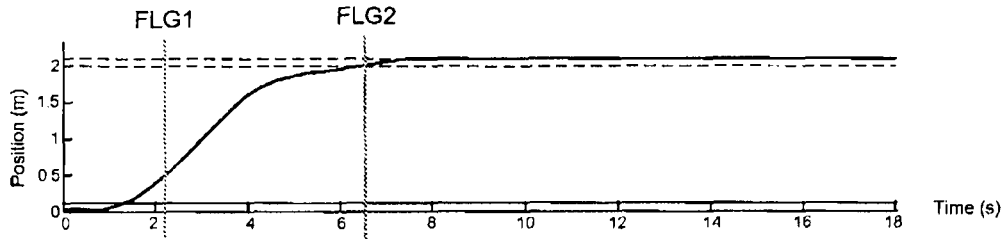
Figure 3B:
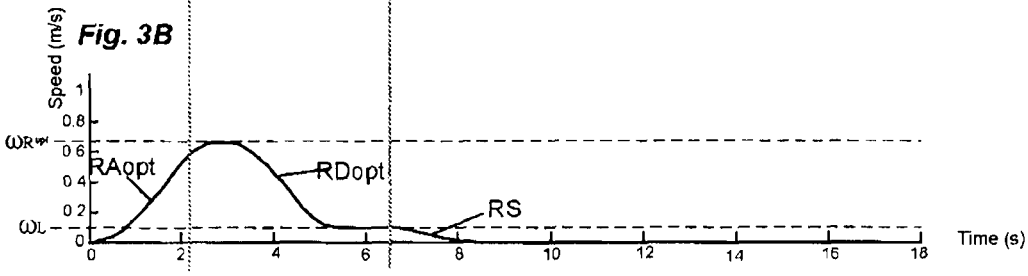

Other characteristics and advantages will be apparent in the detailed description which follows while referring to an embodiment given by way of example and represented by the appended drawings in which:

FIGS. 1A and 1B represent respectively a speed profile and its corresponding position profile that are followed by an elevator moving between two floors while reaching its maximum speed, FIGS. 2A and 2B represent respectively a speed profile and its corresponding position profile that are followed by an elevator moving between two floors without reaching its maximum speed and without application of the method of control of the invention, FIGS. 3A and 3B represent respectively a speed profile and its corresponding position profile that are followed by an elevator moving between two floors without reaching its maximum speed and with application of the method of control of the invention.

As already described previously, with reference to FIG. 1B, a conventional control profile applied in a variable speed drive for controlling a lifting load such as an elevator with the aid of an electric motor comprises the following main steps:

- receipt of a departure order so as to move the elevator from one floor to another,
- acceleration according to an acceleration ramp RA until a maximum speed $\omega_R$ is reached,
- receipt of a deceleration order (FLG1) for example with the aid of a first external sensor placed on the elevator's run,
- deceleration according to a deceleration ramp RD until a low speed $\omega_L$ is reached,
- receipt of a stopping order (FLG2) for example with the aid of a second external sensor placed on the elevator's run,
- deceleration according to a stopping ramp RS until the elevator stops completely at the desired floor.

Each external sensor is stationed on the elevator's run at a certain distance before the desired arrival floor so as to comply with the deceleration and stopping distances.

This type of control profile is implemented by taking account of constraints related to the user's comfort. Indeed, this control profile must be applied in a manner which is comfortable for the user, thereby involving the application of non-linear ramps. For this purpose, two principles are generally applied:

- each ramp (acceleration, deceleration, stopping) must be applied in accordance with a low acceleration, at most equal to 0.5 m/s$^2$,
- the impulses or jerks at the beginning and at the end of each ramp must be limited, for example to a value lying between 0.2 and 0.5 m/s$^3$.

The control profile defined hereinabove is ideal when the elevator moves several levels since the elevator then has sufficient time to reach its maximum speed $\omega_R$ before receipt of the deceleration order (FLG1). On the other hand, when the elevator performs a short run between two floors, for example separated by a single level, the deceleration order (FLG1) may be received before the elevator has had time to reach its maximum speed $\omega_R$. In this case, if the elevator continues to accelerate after receipt of the deceleration order (FLG1), the stopping distances for the desired floor will not be able to be complied with or if the elevator is controlled in deceleration according to the control profile defined hereinabove, the low speed $\omega_L$ will be reached very early and the elevator will therefore be induced to move very slowly at this low speed $\omega_L$ to reach the desired floor as represented in FIGS. 2A and 2B.

According to the invention, when the variable speed drive receives the deceleration order (FLG1) while the elevator is at a current speed below its maximum speed $\omega_R$, the variable drive determines a second speed $\omega_R^{opt}$ below the maximum speed $\omega_R$ and above its current speed, this second speed being an optimal speed up to which the elevator can continue to accelerate so as to minimize the travel time until stopping while complying with the stopping distances (see FIGS. 3A and 3B). The principle of the invention therefore consists in seeking a function of time such that:

$$\begin{cases} \theta = f(t) \\ \omega = f'(t) \\ \gamma = f''(t) \\ j = f'''(t) \end{cases}$$

in which $\omega$ is designated as the current speed of the load, $\theta$ the current position of the load, $\gamma$ represents the acceleration of the load and j represents the impulse ("jerk") of the load.

This function f will have to comply with the following constraints $$: \begin{cases} 0 = f(0) & \theta_{Dd} = f(t_D) \\ \omega_0 = f'(0) & \omega_L = f'(t_D) \\ \gamma_0 = f''(0) & 0 = f''(t_D) \\ & 0 = f'''(t_D) \end{cases}$$

and $|\gamma| < \gamma_{MAX}$, $j < j_{MAX}$ $(\omega_0, \gamma_0)$ represents the trajectory point at the moment of receipt of the deceleration order, $(\omega_L, 0)$ represents the point to be reached of the trajectory and $\theta_{Dd}$ the distance to be traveled during the deceleration motion, between the maximum speed and the low speed. $t_D$ represents for its part the deceleration time.

The pair $(\omega_0, \gamma_0)$ is obtained through the current position of the trajectory.

The distance $\theta_{Dd}$ is known since it is the distance traveled during the first deceleration. If this distance $\theta_{Dd}$ is complied with by the control profile, so also will the stopping distance constraints.

If we add a known time parameter $T_R$ corresponding to a plateau time at the maximum speed reached by the elevator, the solution procedure consists, on the basis of all the known data $(\omega_0, \gamma_0, \theta_{Dd}, T_R)$, in calculating an optimal maximum speed $\omega_R^{opt}$ to be reached which minimizes the total time of the motion.

By definition, the optimal maximum speed is defined by $\omega_R^{opt}=f'(t_R))$ where $t_R$ is such that $f''(t_R)=0$.

Two examples are treated hereinafter to model the function f defined hereinabove.

The first example consists in determining the optimal speed $\omega_R^{opt}$, by considering for example the following control profile, piecewise linear in acceleration (see FIG. 1B):

- acceleration $\gamma_A$ for the time Ta in accordance with an acceleration ramp RA,
- maintaining at the speed $\omega_R$ for a plateau time Tp,
- acceleration $\gamma_D$ for the time Td in accordance with a deceleration ramp RD,
- maintaining at the low speed $\omega_L$ for a time $T_L$ so as to travel the remaining distance until stopping.

The calculation of the optimal speed $\omega_R^{opt}$ is done in compliance with the magnitudes of accelerations and impulses so as to maintain a level of comfort. It may happen that the calculation of the optimal speed modifies the magnitudes of acceleration and impulse as compared with the initial trajectory.

In this first example, we consider that the acceleration ramp for reaching the calculated optimal speed $\omega_R^{opt}$ is the acceleration ramp RA of the initially provided control profile and that the deceleration ramp applied after having reached the optimal speed $\omega_R^{opt}$ is also the deceleration ramp RD of the initially provided control profile.

On the basis of the control profile defined hereinabove in conjunction with FIG. 1B, with ω designated as the current speed of the load and θ the current position of the load, the following reasoning is performed:

Between 0 and Ta (acceleration phase), we have:

$$\omega = \omega_0 + \gamma_A \cdot t$$

$$\theta = \omega_0 \cdot t + \frac{1}{2} \cdot \gamma_A \cdot t^2$$

This giving at Ta:

$$\omega_R = \omega_0 + \gamma_A \cdot T_A$$

$$\theta_R = \omega_0 \cdot T_A + \frac{1}{2} \cdot \gamma_A \cdot T_A^2$$

i.e. with $$T_A = \frac{\omega_R - \omega_0}{\gamma_A}$$

We then obtain:

$$\theta_R = \frac{\omega_R^2 - \omega_0^2}{2 \cdot \gamma_A}$$

Between Ta and Ta+Tp, the speed being constant, we have:

$$\omega = \omega_R$$

$$\theta = \theta_R + \omega_R \cdot t$$

This giving at Ta+Tp:

$$\theta_P = \theta_R + \omega_R \cdot T_P$$

Between Ta+Tp and Ta+Tp+Td (deceleration phase), we have:

$$\omega = \omega_R - \gamma_D \cdot t$$

$$\theta = \theta_p + \omega_R \cdot t - \frac{1}{2} \cdot \gamma_D \cdot t^2$$

This giving at Ta+Tp+Td:

$$\omega_R = \omega_L + \gamma_D \cdot T_D$$

$$\theta_D = \theta_P + \omega_R \cdot T_D - \frac{1}{2} \cdot \gamma_D \cdot T_D^2$$

With $$T_D = \frac{\omega_R - \omega_L}{\gamma_D}$$

We then obtain:

$$\theta_D = \frac{\omega_R^2 - \omega_0^2}{2 \cdot \gamma_A} + \frac{\omega_R^2 - \omega_L^2}{2 \cdot \gamma_D} + \omega_R \cdot T_P$$

Next between Ta+Tp+Td and $T_R$=Ta+Tp+Td+$T_L$, we have:

$$\omega = \omega_L$$

$$\theta = \theta_D + \omega_L \cdot t$$

This giving at $T_R$:

$$\theta_{Dd} = \theta_D + \omega_L \cdot T_L = \frac{\omega_R^2 - \omega_0^2}{2 \cdot \gamma_A} + \frac{\omega_R^2 - \omega_L^2}{2 \cdot \gamma_D} + \omega_L \cdot T_L + \omega_R \cdot T_P$$

under the condition that $T_L > 0$, it follows that:

$$T_L = \frac{\theta_{Dd} - \omega_R \cdot T_P - \frac{\omega_R^2 - \omega_0^2}{2 \cdot \gamma_A} - \frac{\omega_R^2 - \omega_L^2}{2 \cdot \gamma_D}}{\omega_L}$$

We then obtain:

$$T_R = \frac{\omega_R - \omega_0}{\gamma_A} + T_P + \frac{\omega_R - \omega_L}{\gamma_D} + \left[\frac{\theta_{Dd} - \omega_R \cdot T_P - \frac{\omega_R^2 - \omega_0^2}{2 \cdot \gamma_A} - \frac{\omega_R^2 - \omega_L^2}{2 \cdot \gamma_D}}{\omega_L}\right]_{>0}$$

With:

$$T_A = \frac{\omega_R - \omega_0}{\gamma_A}, \; T_D = \frac{\omega_R - \omega_L}{\gamma_D}$$

and $$T_L = \frac{\theta_{Dd} - \omega_R \cdot T_P - \frac{\omega_R^2 - \omega_0^2}{2 \cdot \gamma_A} - \frac{\omega_R^2 - \omega_L^2}{2 \cdot \gamma_D}}{\omega_L}$$

We therefore obtain the result that the travel time is a function of the speed $\omega_R$.

If $T_L<0$, this signifies that the end-of-acceleration and deceleration motions have used up too much distance. Consequently, the time $T_L$ must be positive, thus inducing us to write the following relations:

$$\omega_R^{\theta} = \sqrt{\frac{2\cdot\theta_{Dd} + \frac{\omega_0^2}{\gamma_A} + \frac{\omega_L^2}{\gamma_D}}{\frac{1}{\gamma_A} + \frac{1}{\gamma_D}}}$$

and $$\omega_R^{\gamma} = \frac{T_P}{\frac{1}{\gamma_A} + \frac{1}{\gamma_D}}$$

and to study the constraint:

$$T_L = \frac{\theta_{Dd} - \omega_R\cdot T_P - \left(\frac{1}{\gamma_A} + \frac{1}{\gamma_D}\right)\cdot\frac{\omega_R^2}{2} + \frac{\omega_0^2}{2\cdot\gamma_A} + \frac{\omega_L^2}{2\cdot\gamma_D}}{\omega_L} \geq 0$$

We then obtain the following relation:

$$T_L = \frac{\left(\frac{1}{\gamma_A} + \frac{1}{\gamma_D}\right)\cdot\left(\omega_R^{\theta^2} - 2\cdot\omega_R^{\gamma}\cdot\omega_R - \omega_R^2\right)}{2\cdot\omega_L} \geq 0$$

To fulfill the condition $T_L\geq 0$, it is therefore necessary that $\omega_R^{\theta^2}-2\omega_R^{\gamma}\cdot\omega_R-\omega_R^2\geq 0$ By solving this second-degree equation, we obtain the optimal speed $\omega_R^{opt}$ to be reached taking account of the constraint:

$$\omega_R^{opt}=-\omega_R^{\gamma}+\sqrt{\omega_R^{\gamma^2}+\omega_R^{\theta^2}}$$

To confirm that the speed $\omega_R^{opt}$ is indeed the optimal speed making it possible to minimize the travel time, it suffices to study the following function and its evolution as a function of $\omega_R$:

$$\begin{aligned} T_R(\omega_R) &= \frac{\omega_R - \omega_0}{\gamma_A} + T_P + \frac{\omega_R - \omega_L}{\gamma_D} + \\ &\quad \frac{\theta_{Dd} - \omega_R\cdot T_P - \frac{\omega_R^2 - \omega_0^2}{2\cdot\gamma_A} - \frac{\omega_R^2 - \omega_L^2}{2\cdot\gamma_D}}{\omega_L} \\ &= \left(\frac{1}{\gamma_A} + \frac{1}{\gamma_D}\right)\cdot\omega_R - \frac{\omega_0}{\gamma_A} - \frac{\omega_L}{\gamma_D} + T_P + \\ &\quad \frac{\left(\frac{1}{\gamma_A} + \frac{1}{\gamma_D}\right)\cdot\left(\omega_R^{\theta^2} - 2\cdot\omega_R^{\gamma}\cdot\omega_R - \omega_R^2\right)}{2\cdot\omega_L} \end{aligned}$$

The variation of $T_R$ is determined on the basis of its derivative:

$$\frac{dT_R}{d\omega_R}(\omega_R) = \frac{1}{\gamma_A} + \frac{1}{\gamma_D} - \frac{\left(\frac{1}{\gamma_A} + \frac{1}{\gamma_D}\right)\cdot(\omega_R^{\gamma} + \omega_R)}{\omega_L} = \left(\frac{1}{\gamma_A} + \frac{1}{\gamma_D}\right)\cdot\left(1 - \frac{\omega_R^{\gamma} + \omega_R}{\omega_L}\right)$$

By definition $\omega_R$ is greater than $\omega_L$; it therefore follows that the function $T_R$ is monotonic decreasing on its definition space, that is to say $\omega_R$ in $[\omega_L, \omega_R^{opt}]$.

We therefore note that the time $T_R$ is a minimum when $\omega_R$ is a maximum making it possible to justify the choice of $\omega_R^{opt}=-\omega_R^{\gamma}+\sqrt{\omega_R^{\gamma^2}+\omega_R^{\theta^2}}$. We then obtain:

$$\omega_R = \omega_R^{opt} = -\omega_R^{\gamma} + \sqrt{\omega_R^{\gamma^2} + \omega_R^{\theta^2}} = -\frac{T_P}{\frac{1}{\gamma_A} + \frac{1}{\gamma_D}} + \sqrt{\left(\frac{T_P}{\frac{1}{\gamma_A} + \frac{1}{\gamma_D}}\right)^2 + \frac{2\cdot\theta_{Dd} + \frac{\omega_0^2}{\gamma_A} + \frac{\omega_L^2}{\gamma_D}}{\frac{1}{\gamma_A} + \frac{1}{\gamma_D}}}$$

In the second example, the speed ramps are calculated on the basis of a time-dependent polynomial of order 6. By construction, the speed follows a continuous and non-linear profile. We also consider that the acceleration ramp for reaching the calculated optimal speed $\omega_R^{opt}$ is also the acceleration ramp RA of the initially provided control profile and that the deceleration ramp applied after having reached the optimal speed $\omega_R^{opt}$ is also the deceleration ramp RD of the initially provided control profile. Let us consider the following polynomial P of order 6:

$$P=a_6\cdot X^6+a_5\cdot X^5+a_4\cdot X^4+a_3\cdot X^3+a_2\cdot X^2+a_1\cdot X+a_0$$

Let us define the function of time f such that:

$$f(t) = P\left(\frac{t}{t_D}\right)$$

By definition, we can express the position θ, the speed ω, the acceleration γ, and the impulse j on the basis of the function f and its derivatives.

$$\begin{cases} \theta = f(t) \\ \omega = f'(t) \\ \gamma = f''(t) \\ j = f'''(t) \end{cases}$$

with the constraints $$\begin{cases} 0 = f(0) & \theta_{Dd} = f(t_D) \\ \omega_0 = f'(0) & \omega_L = f'(t_D) \\ \gamma_0 = f''(0) & 0 = f''(t_D) \\ & 0 = f'''(t_D) \end{cases} \quad \text{and } |\gamma| < \gamma_{MAX}, \quad j < j_{MAX}$$

$(\omega_0, \gamma_0)$ represents the trajectory point at the moment of receipt of the deceleration order, $(\omega_L, 0)$ represents the point to be reached of the trajectory, and $\theta_{Dd}$ the distance to be traveled during the deceleration motion, between the maximum speed and the low speed. $t_D$ represents for its part the deceleration time.

The pair $(\omega_0, \gamma_0)$ is obtained through the current position of the trajectory.

The distance $\theta_{Dd}$ is known since it is the distance traveled during the first deceleration. If this distance $\theta_{Dd}$ is complied with by the control profile, so also will the stopping distance constraints.

We therefore have to find the coefficients of the polynomial P satisfying the constraints:

$$\begin{cases} 0 = P(0) & \theta_{Dd} = P(1) \\ \omega_0 \cdot t_D = P'(0) & \omega_L \cdot t_D = P'(1) \\ \gamma_0 \cdot t_D^2 = P''(0) & 0 = P''(1) \\ & 0 = P'''(1) \end{cases}$$

It follows that:

$$a_6 = -10 \cdot \theta_{Dd} + 6 \cdot \omega_L \cdot t_D + 4 \cdot \omega_0 \cdot t_D + \frac{1}{2} \cdot \gamma_0 \cdot t_D^2$$

$$a_5 = 36 \cdot \theta_{Dd} - 21 \cdot \omega_L \cdot t_D - 15 \cdot \omega_0 \cdot t_D - 2 \cdot \gamma_0 \cdot t_D^2$$

$$a_4 = -45 \cdot \theta_{Dd} + 25 \cdot \omega_L \cdot t_D + 20 \cdot \omega_0 \cdot t_D + 3 \cdot \gamma_0 \cdot t_D^2$$

$$a_3 = 20 \cdot \theta_{Dd} - 10 \cdot \omega_L \cdot t_D - 10 \cdot \omega_0 \cdot t_D - 2 \cdot \gamma_0 \cdot t_D^2$$

$$a_2 = \frac{1}{2} \cdot \gamma_0 \cdot t_D^2$$

$$a_1 = \omega_0 \cdot t_D$$

$$a_0 = 0$$

By definition, the optimal speed reached during the motion is then defined by $\omega_R^{opt} \cdot t_D = P'(x)$, where x is such that $P''(x)=0$.

The optimal speed calculated by virtue of the first or second example is inserted into a new control profile determined by the variable drive when the deceleration order (FLG1) is received while the maximum speed $\omega_R$ provided in the initial control profile has not been reached. This second control profile is determined by taking account of the new calculated optimal speed $\omega_R^{opt}$, while complying with the two principles previously defined relating to the accelerations and impulses to be applied so as to guarantee optimal comfort for the user and by taking account of the remaining distance to be traveled.

This new control profile therefore comprises, after receipt of the deceleration order (FLG1), the following steps:

- acceleration up to the optimal speed $\omega_R^{opt}$ calculated according to a new acceleration ramp $RA^{opt}$ taking account in particular of the remaining distance to be traveled,
- deceleration according to a new deceleration ramp $RD^{opt}$, also taking account of the remaining distance to be traveled, until the low speed $\omega_L$ is reached,
- receipt of the stopping order (FLG2) for example with the aid of the second external sensor placed on the elevator's run,
- deceleration according to the stopping ramp RS until the elevator stops completely at the desired floor.

The new ramps $RA^{opt}$, $RD^{opt}$ calculated are of course non-linear so as to comply with the comfort constraints.

According to the invention, in certain cases, the initial ramps RA and RD can no longer be complied with and it is necessary to determine new ramps making it possible to comply with the imposed distance. For example, if the distance to be traveled is too large to reach the optimal speed $\omega_R^{opt}$ when the initial acceleration ramp RA is applied, it is necessary to determine a new ramp which will be steeper.

This new control profile can in particular comprise a step of maintaining the speed of the load at the optimal speed $\omega_R^{opt}$ so as to create a plateau at this speed for a determined duration, lying between zero and several seconds, and a step of maintaining the speed of the load at the low speed $\omega_L$ for a certain duration that can go from zero to several seconds, before receipt of the stopping order (FLG2).

It is of course possible, without departing from the scope of the invention, to contemplate other variants and refinements of detail and likewise envisage the use of equivalent means.

The invention claimed is:

1. A method of control implemented in a variable speed drive for controlling a lifting load, the control of the load being carried out according to a first control profile which comprises:

acceleration of the load with a view to reaching a first speed in accordance with a first non-linear acceleration ramp;

deceleration of the load subsequent to receipt of a deceleration order; and stopping of the load;

wherein when the load receives the deceleration order while it is at a current speed below the first speed, the method further comprises:

determining a second speed below the first speed and above the current speed, the second speed having an optimal value so as to minimize a travel time of the load until stopping; and generating and applying a second control profile replacing the first control profile and comprising accelerating the load until reaching the second speed according to a second non-linear acceleration ramp taking account a remaining distance to be traveled, followed by a deceleration and by a stopping.

2. The method as claimed in claim 1, wherein the second control profile comprises maintaining the speed of the load at the second speed for a determined duration.

3. The method as claimed in claim 1, wherein, between the deceleration and the stopping, the second control profile comprises maintaining the speed of the load at a third speed below the second speed.

4. The method as claimed in claim 1, wherein, on completion of the deceleration, the second control profile comprises receiving a stopping order.

5. The method as claimed in claim 4, wherein after receipt of the stopping order, the second control profile comprises deceleration until stopping.

6. The method as claimed in claim 4, wherein the deceleration order or the stopping order is dispatched by a sensor in front of which the lifting load passes.

7. The method as claimed in claim 4, wherein the deceleration order or the stopping order is dispatched by an automaton connected to the variable speed drive.

8. A variable speed drive for controlling a lifting load, a control of the load being carried out according to a first control profile which comprises:

acceleration of the load with a view to reaching a first speed in accordance with a first non-linear acceleration ramp;

receipt of a deceleration order;

deceleration of the load; and stopping of the load;

wherein when the load receives the deceleration order at a current speed below the first speed, the variable speed drive implements:

means for determining a second speed below the first speed and above the current speed, the second speed having an optimal value so as to minimize a travel time of the load until stopping; and means for generating and implementing a second control profile replacing the first control profile and comprising accelerating the load until reaching the second speed according to a second non-linear acceleration ramp taking account a remaining distance to be traveled, followed by a deceleration and by a stopping.

9. The variable drive as claimed in claim 8, further comprising means for maintaining the speed of the load at the second speed for a determined duration.

10. The variable drive as claimed in claim 8, wherein the variable speed drive comprises means for maintaining the speed of the load at a third speed below the second speed.

11. The variable drive as claimed in claim 8, wherein the second control profile comprises a receipt of a stopping order.

12. The variable drive as claimed in claim 11, wherein the second control profile comprises a deceleration until stopping subsequent to the receipt of the stopping order.

13. The variable drive as claimed in claim 11, connected to an external sensor configured to dispatch the deceleration order or the stopping order when it detects passage of the lifting load.

14. The variable drive as claimed in claim 11, connected to an automaton configured to dispatch the deceleration order or the stopping order.

* * * * *